United States Patent [19]

Taguchi et al.

[11] Patent Number: 4,890,986

[45] Date of Patent: Jan. 2, 1990

[54] VARIABLE CAPACITY COMPRESSOR

[75] Inventors: Tatsuhisa Taguchi, Katano; Yoshikazu Abe, Hirakata; Kiyoji Aburaya, Ohtsu, all of Japan

[73] Assignee: Matsushita Electric Industrial Co., Ltd., Osaka, Japan

[21] Appl. No.: 111,314

[22] Filed: Oct. 22, 1987

[30] Foreign Application Priority Data

Oct. 23, 1986 [JP] Japan ..... 61-252209

[51] Int. Cl.[4] ..... F04B 49/02; F04C 29/08

[52] U.S. Cl. ..... 417/295; 417/310

[58] Field of Search ..... 417/295, 310, 440, 304; 418/159, 15

[56] References Cited

U.S. PATENT DOCUMENTS 3,026,809 3/1962 Anderson et al. .
4,557,670 12/1985 Inagaki et al. .

FOREIGN PATENT DOCUMENTS 128487 8/1983 Japan ..... 417/310
195001 11/1983 Japan ..... 417/440
96495 6/1984 Japan ..... 417/440
99089 6/1984 Japan ..... 418/15
1887 1/1986 Japan ..... 417/304
232397 10/1986 Japan ..... 418/159

OTHER PUBLICATIONS

Patent Abstract of Japan, vol. 12, No. 64 (M-672)[2911], published Feb. 26, 1988, re JP-A-62 210 286, (Matsushita Elec. Ind.), 16-09-87.

*Primary Examiner*—William L. Freeh
*Attorney, Agent, or Firm*—Darby & Darby

[57] ABSTRACT

In a variable capacity compressor having a rotary type cylinder compartment (24*a*), plural return ports (33) formed in a volume-decrease-step space in the cylinder compartment (24*a*), an exit (34) formed in a volume-increase-step space in the cylinder compartment (24*a*), a C-shaped guide passage (35) for connecting the plural return ports (33) and the exit (34), an arc-shaped slider (36) provided slidably for gradually opening and closing the plural return ports (33), a spring (37) for pushing the arc-shaped slider (36), and a pressure control valve (42) for pushing the arc-shaped slider (36) in opposite direction to the pushing of the spring are provided; and thereby a wide variable capacity range is realized with compact size and high efficiency.

2 Claims, 10 Drawing Sheets

FIG,1 (Prior Art)

VARIABLE CAPACITY COMPRESSOR

FIELD OF THE INVENTION AND RELATED ART STATEMENT

1. FIELD OF THE INVENTION

The present invention relates to a compressor which is applicable, for instance, for an air conditioner of a car, and more particularly relates to an improvement in a variable capacity compressor.

2. DESCRIPTION OF THE RELATED ART

Recently, improvement in a compressor which is used for air conditioner of a car has been directed to develop a variable capacity compressor for enabling saving capacity and improving comforts. In a reciprocation type compressor, a compressor, which has five cylinders and single wobble plate type and has a structure wherein an a displacement can be varied by changing inner pressure of a crank-case thereby to change a wobbled angle of the wobble plate, is possible to control cooling capacity continuously from 10 to 100 percent. However, the reciprocation type compressor is inferior to a rotary type compressor in respects of compactness and silence. Therefore, it has been much expected to develop a rotary type variable capacity compressor.

In 1986, compressors which were of rotary type and possible to control capacity by function of a by-pass cylinder was put on market by Nippon Denso Co., LTD. Basic structure of control mechanism of the compressor is shown in FIG. 1. In the figure, a spool valve 1, which is cylindrical-shaped and is disposed inside an enclosure 8, is energized by a spring 2 in a direction which makes two by-pass holes 3 open. Refrigerant gas is fed from the suction compartment 4 to a cylinder (not shown), and the gas exhausted out of the cylinder comes in the enclosure 8 through the by-pass holes 3 and returns to a suction compartment 4 which is provided adjacently and connected next to the enclosure 8. Pressure in a pressure control compartment 5, which is at the part above the spool valve 1 and is applied with a near exhaust pressure 10 of the cylinder, is adjusted by automatical controlling opening of a valve 7 in a pressure regulator 6 by means of relation between the pressure of the suction compartment 4 and the atmospheric pressure 9 so as to keep pressure of the suction compartment 4 constant. Thus, opening of the by-pass holes 3 is antomatically adjusted, hence to control amount of outflowing of the gas into the suction compartment 4. The above-mentioned conventional variable capacity compressor has the following shortcomings.

Firstly, in the above-mentioned structure, since the spool valve 1 reciprocates on a straight line, freedom of arrangement of the by-pass holes 3 around a cylinder or a cylinder compartment having circular cross-section and a cross-sectional area of a passage of the by-pass holes 3 are restricted. In fact, variable range of capacity of this compressor is not sufficiently wide (i.e. it is about 50–100 percent cooling capacity).

Secondly, when a large cooling capacity is required, the spool valve 1 is pushed with a high pressure, and thereby the by-pass holes 3 are closed. In such state, since the pressure regulator 6 always apply high pressure, which is near to an exhaust pressure, to the pressure control compartment 5, the gas is likely to leak to the suction compartment 4 through a circumference of the spool valve 1. Thereby the cooling capacity is decreased.

Thirdly, in the above-mentioned structure, that is, when the configuration is made as is stated in Japanese Unexamined Published Application Sho 58-128487, since cross-sectional areas of the by-pass holes are selected gradually to increase as the order of the holes advances in a rotating direction of rotor, much gas leaks (namely reexpands) to a backward cylinder compartment at the time immediately after passing of a vane. This is not desirable for the point of view of efficiency improvement.

Forthly, the conventional variable capacity compressor was structured that the gas coming through the by-pass holes 3 is led to the suction compartment 4 which is adjacent to the enclosure 8. However, provision of the suction compartment 4 needs enlargement of whole configuration of the compressor. This prevents the compressor from miniaturization. Similarly, it is not preferable to provide another by-pass as shown in the other prior art, which is Japanese Unexamined Published Application No. Sho 58-211591.

OBJECT AND SUMMARY OF THE INVENTION

The object of the present invention is to provide a variable capacity rotary commpressor having bypass cylinder which is capable of having widely variable capacity range thereof, and to make the variable capacity range wide without lowering the cooling capacity and the efficiency.

The variable capacity compressor in accordance with the present invention comprises:

- an enclosure having cylindrical internal space, a cylindrical-shaped rotor which is rotatably held in the enclosure and driven by an external force and has vanes, plural return ports being formed on a wall of volume-decrease-step space in the internal space wherein volume of sectioned space by movements of the rotor and the vanes is changed cyclically, an exit being formed on the wall of volume-increase-step space in the internal space wherein volume of sectioned space by movements of the rotor and the vanes is changed cyclically, and a C-shaped guide passage being formed in the wall for connecting the plural return ports and the exit,
- an arc-shaped slider which is provided slidably in the C-shaped guide passage for opening and closing the plural return ports,
- energizing means for energizing the arc-shaped slider in a circumferential direction thereof, and
- pressure control means for adjusting pressure of gas which pushes the arc-shaped slider in reverse direction to the energizing means.

The above-mentioned variable capacity compressor has the following advantages.

Since the return ports can be formed up to a high position of rotation angle around the rotor and can assure sufficiently large cross-sectional area of the return ports, high control factor (i.e. wide control range of output capacity) is achievable.

Further, since the C-shaped guide passage can also be used as a return passage, another return passage or suction compartment is not required, and thereby a variable capacity compressor of compact size can be offered.

BRIEF DESCRIPTION OF THE DRAWINGS

FIG. 11 is a graph of rotation speed—input torque characteristic curve of four types of the compressor.

DESCRIPTION OF THE PREFERRED EMBODIMENT

Figure 1:
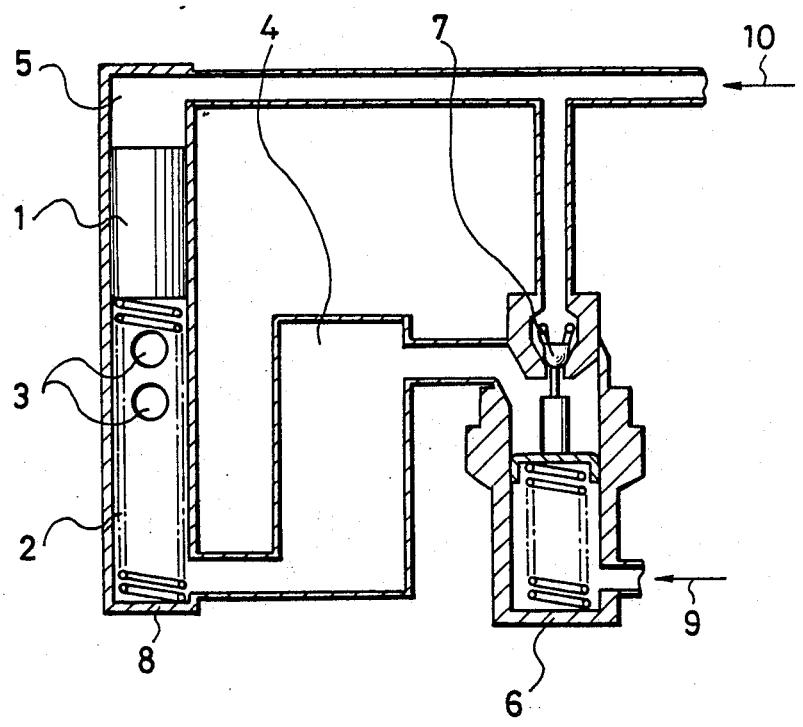
FIG. 1 is the structural schematic view of the conventional variable capacity compressor.
Figure 2:
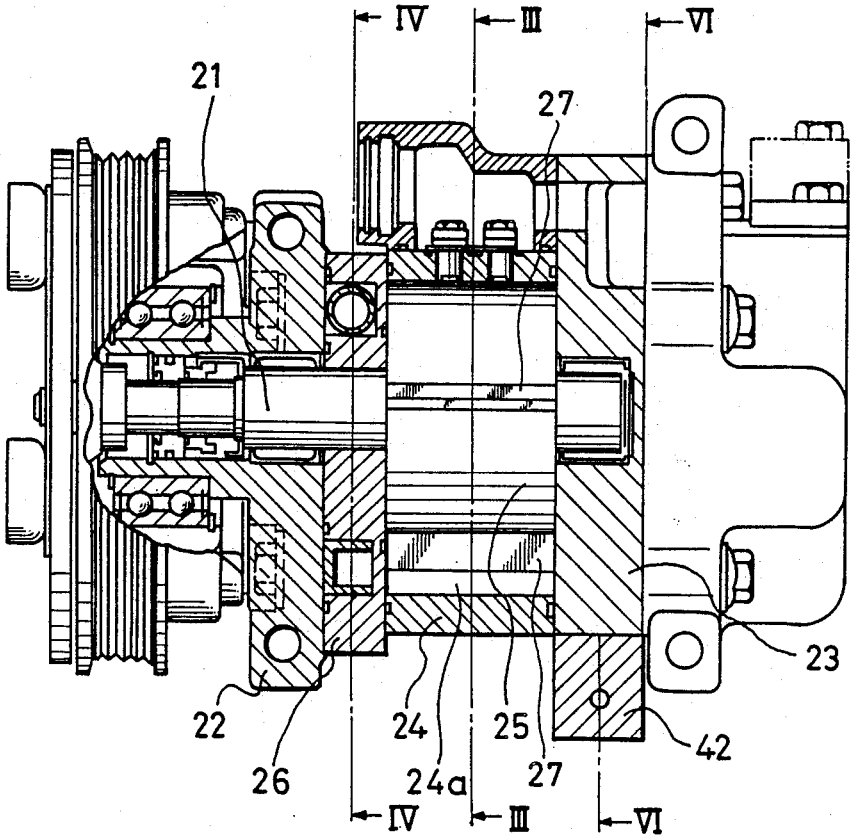
FIG. 2 is a cross-sectional view showing first embodiment of a variable capacity compressor of the present invention.

Hereafter, preferred embodiments of the present invention is described with reference to the accompanying drawings. FIG. 2 shows a cross-sectional view of an embodiment of a variable capacity compressor.

Figure 3:
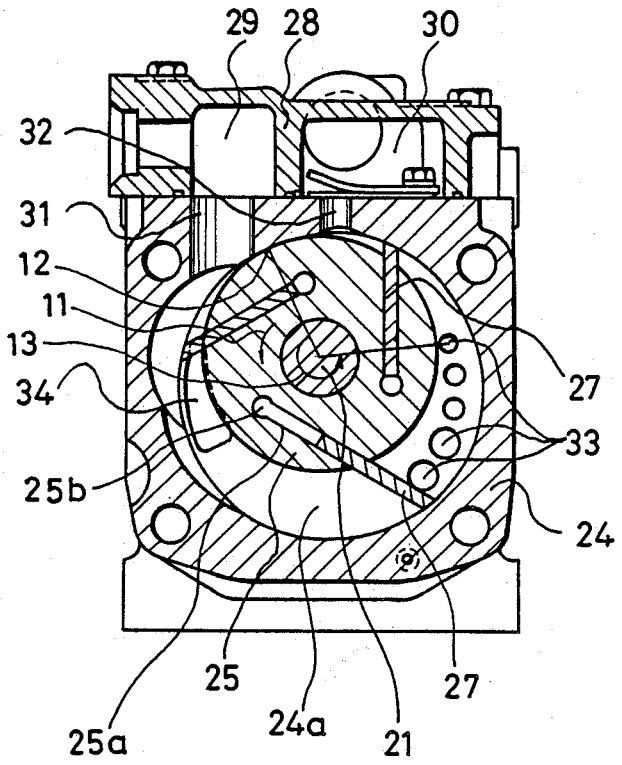
FIGS. 3 and 4 are cross-sectional views taken on line III—III and IV—IV in FIG. 2, respectively.
Figure 4:
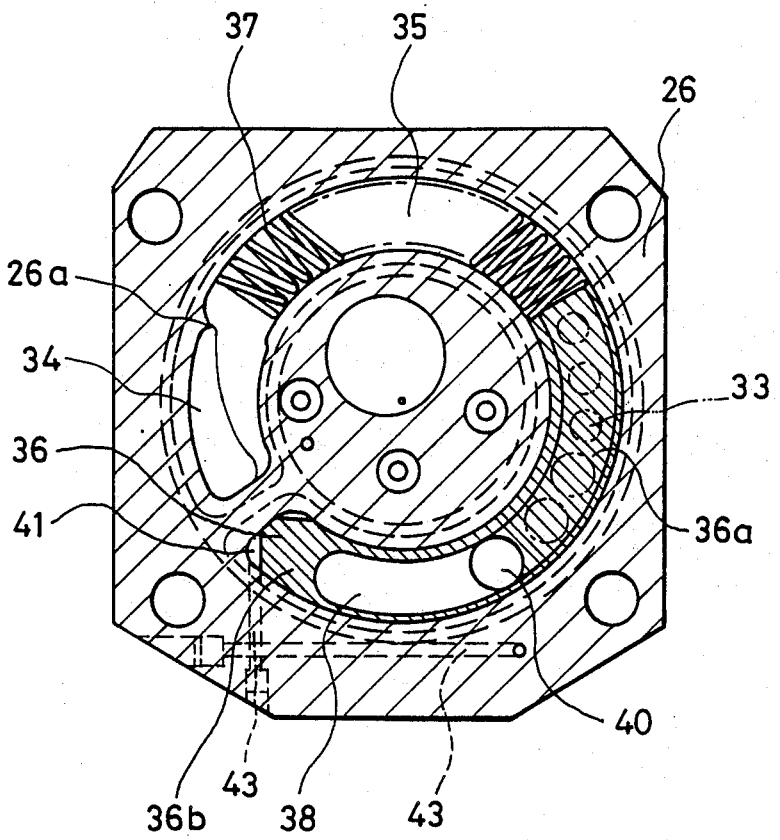
Figure 5A:
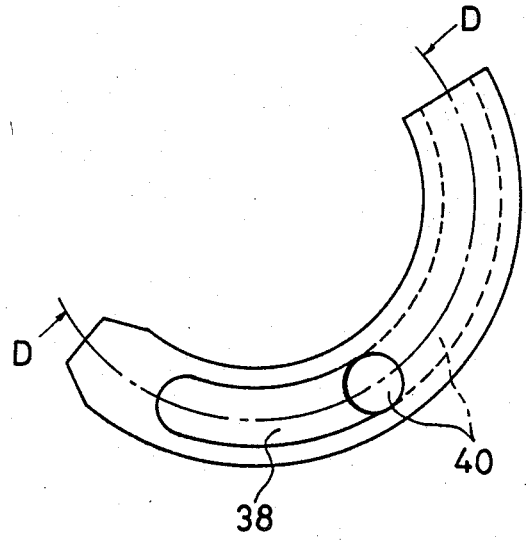
FIG. 5*a* is a plane view of a slider of FIG. 4.
Figure 5B:
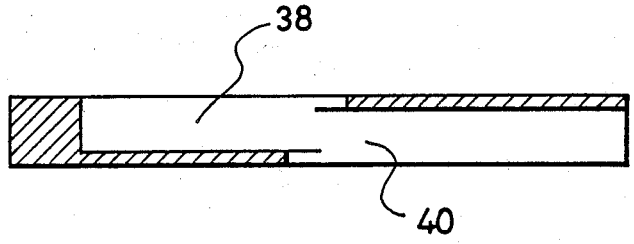
FIG. 5*b* is a developed cross-sectional view taken on line D—D of FIG. 5*a*.
Figure 6:
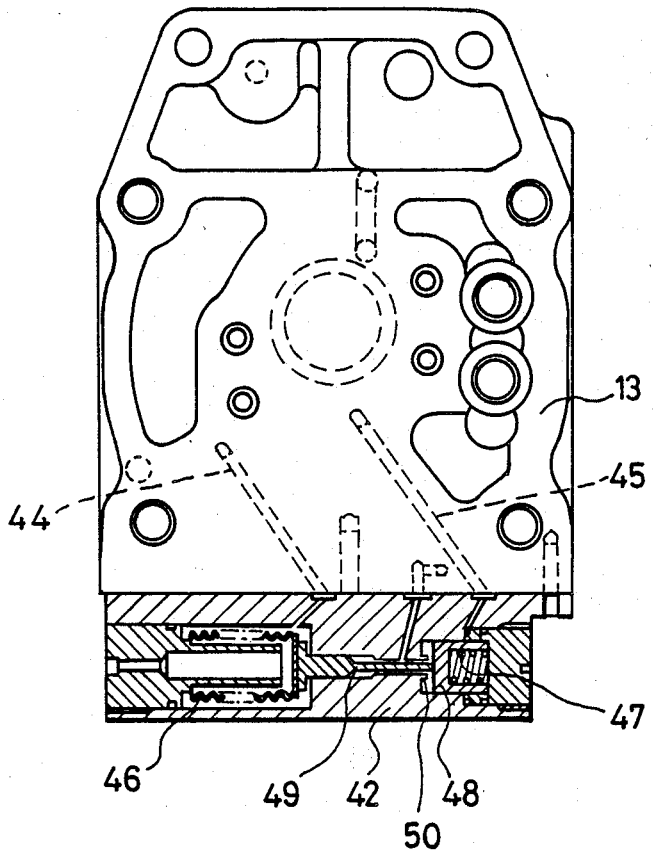
FIG. 6 is a cross-sectional view taken on line VI—VI in FIG. 2.
Figure 7:
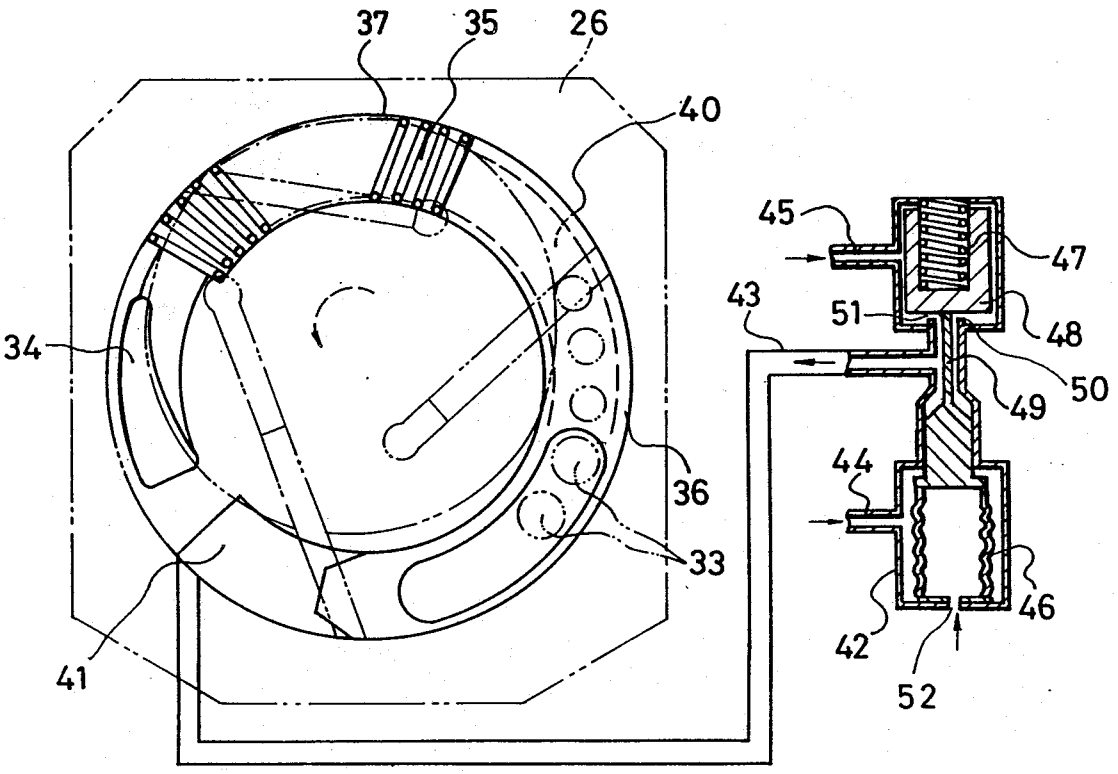
FIG. 7 is a schematic illustration showing control mechanism of a variable capacity compressor of the present invention.

FIGS. 3, 4 and 6 are cross-sectional views taken on line III—III, IV—IV and VI—VI in FIG. 2, respectively. In FIG. 2, a shaft 21 is held by known pin-roller bearings (not shown) which are provided in a front plate 22 and a rear plate 23. A rotor 25 which is shrunk on the shaft 21 rotates in a direction shown by an arrow 11 (FIG. 3) in a cylinder 24. A mechanical plate 26 is provided between the cylinder 24 and the front plate 22. In FIG. 3, vanes 27 are inserted to be slidably held in plural slits 25*a* which are formed in the rotor 25 in radial directions. A cylinder-head cover 28 has a suction compartment 29 and an exhaust compartment 30 therein. A suction inlet 31 and an exhaust outlet 32 which are formed in the cylinder 24 such refrigerant gas and exhaust it after compression in each compression cycle, respectively, as the rotor 25 rotates. Plural return ports 33 are formed on the mechanical plate 26 (FIG. 2) in volume-decrease-step space, which is a space sectioned by the vanes 27 in the cylinder compartment 24a and decreases by rotation of the rotor 25. And the return ports 33 are disposed in an arc-shape in such manner that a cross-sectional area thereof decreases one by one in the rotating direction of the rotor 25. An exit 34 of a return passage (not shown) from the return ports 33 opens in volume-increase-step space, which is a space sectioned by the vanes 27 in the cylinder compartment 24*a* and increases by rotation of the rotor 25. In FIG. 4, a half arc-shaped slider 36 is provided slidably in a C-shaped guide passage 35. The words "C-shaped" means substantially of ring shape but having a break off part therein. A coiled spring 37 which is ristricted to rotate anticlockwise by a projection 26*a* energizes the slider 36 in clockwise direction of the figure. The slider 36 has an arc-shaped aperture 38 for opening the return ports 33 which are provided in the mechanical plate 26 at a surface thereof which faces to the cylinder 24 (FIG. 2), and has a sealing part 36*a* and a sealing part 36*b* at both sides of the aperture 38. Therefore, the return ports 33 are closed by the sealing part 36*a* of the slider 36. A passage 40 for passing return gas which flows from the return ports 33 into the aperture 38 of the slider 36, is formed inside the slider 36. The return gas passes through this passage 40 and further, passes through the guide passage 35, and returns to the cylinder compartment 24*a* (FIG. 3) out of the exit 34. A pressure control compartment 41 is formed at clockwise end of the slider 36, and control pressure is applied thereto via a control pressure lead-in pipe 43 from a pressure control valve 42 (FIG. 7). Thereby the slider 36 is pushed to a direction that makes the return ports 33 open. FIG. 5*a* shows a plane view of the slider 36, and FIG. 5*b* is a developed cross-sectional view taken on line D—D of FIG. 5*a*. Next, as shown in FIG. 6, the aforementioned pressure control valve 42 is fixed under a rear plate 13. A suction pressure lead-in pipe 44 opens an end thereof at near position where suction step is finished, in the cylinder compartment 24*a* (FIG. 3). High pressure lead-in pipe 45 which is provided in the rear plate 13 opens an end thereof in a oil ditch (not shown) for supplying high pressure to a back portion 25*b* (FIG. 3) of the vane 27 (FIG. 3). The pressure control valve 42 comprises a bellows 46, a valve spring 47, a valve 48, a valve bank 50 and a rod 49 which is fixed to the bellows 46. The bellows 46 expands/shrinks by differential pressure between the suction pressure and the atmospheric pressure, and thereby the rod 49 pushes/releases the valve 48 which is energized to push the valve bank 50.

Next, operations of the above-mentioned variable capacity compressor will be described.

As for the air conditioner (not shown) of the car, the compressor is generally rotated by the engine via a belt or the like means. Therefore, when temperatures outside/inside the car are kept constant, cooling capacity and input characteristic of the air conditioner comprising a fixed displacement compressor shows a tendency that the suction pressure gradually decreases and the cooling capacity gradually increases responding to increase of rotation speed of the compressor, respectively. And, power consumption of the engine increases substantially in proportion to the rotation speed. Therefore, coefficiency of capacity showing efficiency of cooling capacity per the power consumption of the engine decreases responding to increase of the rotation speed.

Next, cyclic characteristic of the variable capacity compressor will be described. FIG. 7 is a schematic illustration showing control mechanism of the variable capacity compressor, which represents constant suction pressure control. In the pressure control valve 42, when the suction pressure applied through a suction pressure lead-in pipe 44 decreases below a predetermined value by comparing with the atmospheric pressure applied through an inlet 52, the bellows 46 expands, and thereby the rod 49 pushes the valve against the valve spring 47 to make a gap 51 between the valve bank 50 and the valve 48. High pressure gas flows from a high pressure lead-in pipe 45 into the control pressure lead-in pipe 43 through the above-mentioned gap 51 and is led to the pressure control compartment 41 of the mechanical plate 26. Thereby, the slider 36 slides anticlockwise against force of the coil spring 37, and makes the return ports 33 open in nearer order to the pressure control compartment 41. As a result, some amount of the gas, which corresponds to an opening of the return ports 33, in the cylinder compartment 24*a* (FIG. 3) flows into the return ports 33, and passes through the passage 40 in the slider 36 and the guide passage 35. Thereafter the gas returns to the cylinder compartment 24a (FIG. 3), which is for suction step, bypassing through the exit 34. Thus, amount of the gas which is exhausted out of the compressor decreases as a result of the bypassing through the exit 34, and thereby pressure balance between the suction pressure and the exhaust pressure in refrigerating cycle is changed, and hence the suction pressure increases. When the suction pressure increases over the predetermined value, the gap 51 between the valve 48 and the valve bank 50 is made small, and thereby amount of the gas flowing into the control pressure lead-in pipe 43 decreases. Therefore, the pressure of the pressure control compartment 41 decreases, and thereby the slider 36 slides clockwise by the force of the coil spring 37 so that opening area of the return ports 33 decreases. The above-mentioned operation of the slider 36 is repeated until the suction pressure becomes equal to the predetermined value, and the slider 36 is restored to a stable position, though making slight tremble. When the slider 36 is energized to close the return ports 33 by the coil spring 37 thereby to output the maximum cooling capacity, pressure of the pressure control compartment 41 becomes equal to the suction pressure owing to leakage from the pressure control compartment 41 to the exit 34 through small clearance between arc-shaped slider 36 and the guide passage 35.

Next, the points to be noted of this embodiment will be described. (i) In FIG. 3, a first point is a position where the return ports (e.g. 33 of FIG. 3) are disposed. A position of the slider 36 turned anticlockwise to its maximum position results maximum gas bypassing, namely minimum displacement of the compressor. Therefore, to obtain a large control factor of the compressor, the return ports 33 should be arranged up to high position of rotation angle which is taken anticlockwise from a contact point 12 of the rotor 25 and the cylinder 24 (maximum rotation angle of the return ports 33 is shown by an arrow 13 in FIG. 3). (ii) A second point is cross-sectional area of the return ports (e.g. 33 of FIG. 3). Namely, sum of the cross-sectional area of the return ports 33 determines maximum control factor responding to rotation speed of the compressor.

In other words, (i) when the maximum rotation angle of the return ports 33 is limited low, it is limited to make the maximum control factor high (i.e. to make the displacement small), while (ii) smallness of cross-sectional area of the return ports 33 causes to lower the maximum control factor in high rotation speed because of rate of by-pass flow saturates at the high rotation speed, even though the maximum rotation angle 13 is selected large. Therefore, to get high maximum control factor (i.e. to get wide control range), the configuration which enables the larger angular disposition of the return ports 33, and the larger cross-sectional area of the return ports 33 are desirable.

With respect to the above, the first characteristic of the present invention is that the mechanical plate 26 (FIG. 4) having the C-shaped guide passage 35 for disposing the return ports 33 (FIG. 3) into arc-shaped configuration is provided along the cylinder 24 (FIGS. 2, 3). This becomes possible because of a circle-shaped cross section of the cylinder compartment 24a (FIG. 3) wherein the arc-shaped slider 36 (FIG. 4) slides to open/close the return ports 33 (FIG. 4). In this embodiment, the return ports 33 are disposed within the rotation angle $\theta$ of the rotor 25 as follows:

$$190° < \theta < 255°,$$

and the above range of the rotation angle corresponds to the variable range of displacement from 15 to 100 percent. In physically, the rotation angle $\theta$ can be made larger up to nearly equal to 360°.

Figure 8:
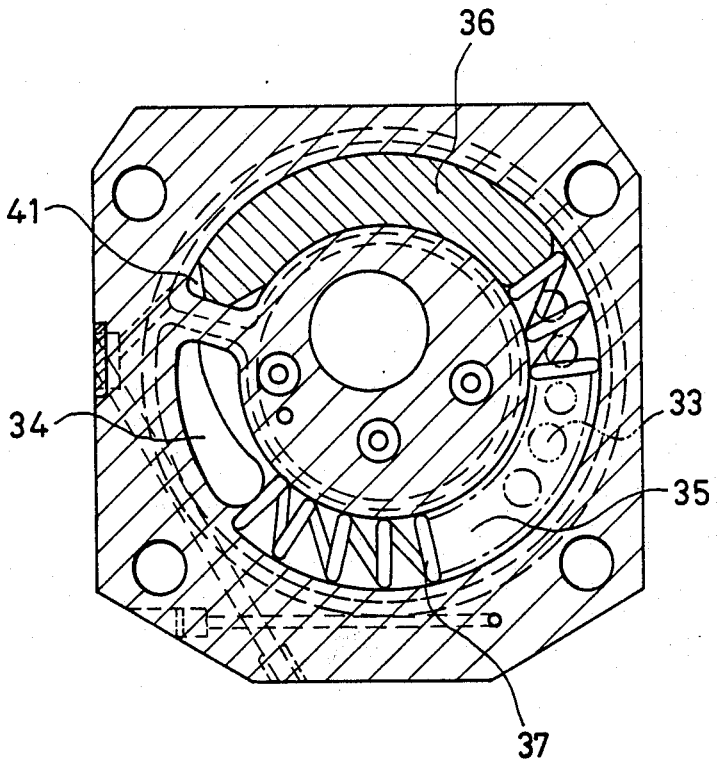
FIG. 8 is a cross-sectional view showing another embodiment of the present invention.

FIG. 8 is a cross-sectional view showing another embodiment of the present invention. In the figure, the slider 36 is energized to open the return ports 33 by the coil spring 37. Therefore, the pressure control compartment 41 is formed in an anticlockwise end of the guide passage 35, whih is opposite to the first embodiment. Other parts are configurated similar to the first embodiment. Return gas passes through the guide passage 35 without passing through inside of the slider 36, and returns to the cylinder comparetment 24a (FIG. 3) which is in suction process from the exit 34. The return ports 33 are disposed in a similar arrangement to the first embodiment.

Figure 9:
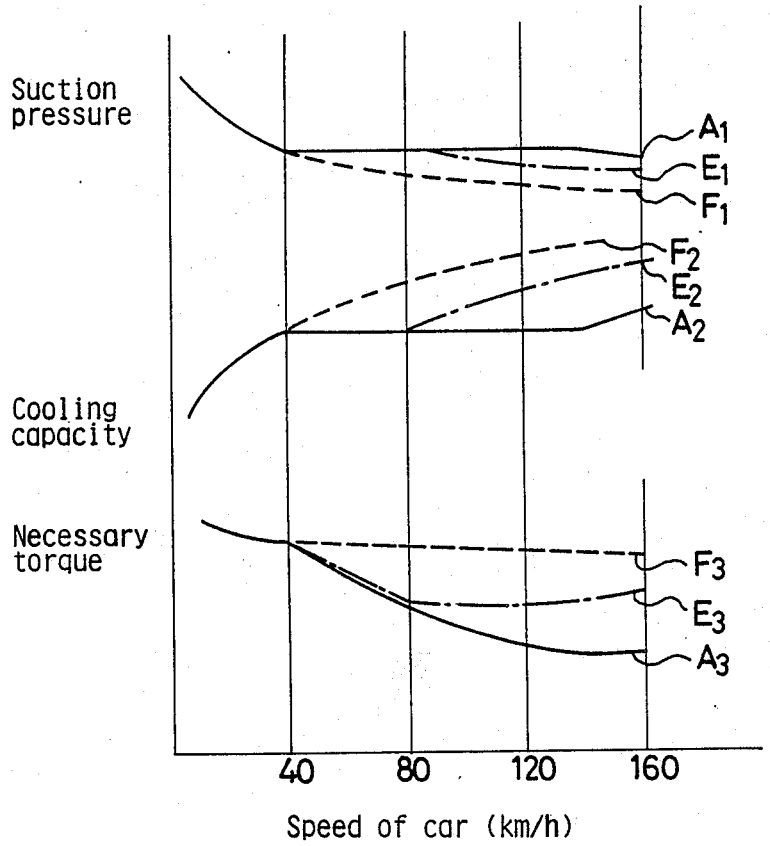
FIG. 9 is various characteristic curves of three types of the compressor.

FIG. 9 shows characteristic of the variable capacity compressor of the present invention (solid line curves) and that of the conventional variable capacity compressor (Japanese Unexamined Published Application Sho No. 58-211591) (chain line curves) and that of the fixed displacement (fixed capacity) compressor (broken line curves), used as air-conditioner of a car. Characteristic curves $A_1$, $E_1$ and $F_1$ show suction pressures of the above-mentioned three compressors, respectively. Characteristic curves $A_2$, $E_2$ and $F_2$ show cooling capacities of the above-mentioned three compressors, respectively. Furthermore, characteristic curves $A_3$, $E_3$ and $F_3$ show necessary torques of the above-mentioned three compressors, respectively. The horizontal axis shows speed (km/h) of the car. According to the characteristic curves $A_1$, $A_2$ and $A_3$ of the variable capacity compressor of the present invention, it is clear that the suction pressure is controlled constant within the wide range which is from 40 to 140 km/h in speed of the car (i.e. from 1500 to 5000 rpm in rotation speed of the engine) and that capacity saving is remarkably attained.

Figure 10:
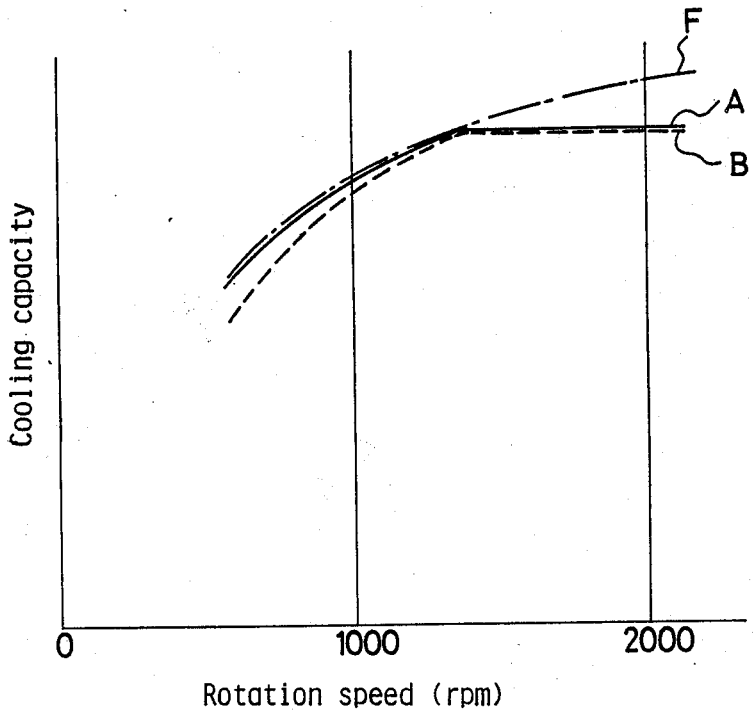
FIG. 10 is a graph of rotation speed—cooling capacity characteristic curve of three types of the compressor.

Next, a second characteristic of the present invention will be described based on results of experimentation. The second characteristic of the present invention is that pressure of the pressure control compartment 41 is made in a state of the suction pressure at the driving time when the slider 36 is energized to close the return ports 33 by the coil spring 37, thereby to output the maximum cooling capacity. Advantage given by this characteristic will be described with reference to FIG. 10. The horizontal axis shows the rotation speed per minute of the compressor, and the vertical axis shows the cooling capacity. Characteristic curves A, B and F belong to the variable capacity compressor of the first embodiment and that of the second embodiment and the fixed displacement compressor, respectively. As shown in the figure, the variable capacity compressor shows the excellent characteristic curve A having few difference of the cooling capacity from the characteristic curve F of the fixed displacement compressor, up to the maximum cooling capacity thereof (i.e. up to about 1400 rpm by the rotation speed). On the other hand, the characteristic curve B of the second embodiment shows such undesirable characteristic that the cooling capacity decreases at low rotation speed.

Finally, a third characteristic of the present invention will be described. Originally, the return ports 33 (FIG. 3) cause to lower the efficiency of the compressor at the maximum cooling capacity, while contributes to control the cooling capacity. Therefore, suitable design not only for making the control range wide but also for reducing lowering of the efficiency is required. Further, the displacement should be continuously changed without steps responding to movement of the slider 36 (FIG. 7) in order to control the capacity smoothly. And variable range of the control pressure should be made wide, in respects of stability for control. FIG. 11 shows a graph showing rotation speed - input torque characteristics of the compressor. The characteristic curves A, C and D are based on such configuration of the return ports that the cross-sectional areas of the return ports are made gradually smaller one by one, uniform and gradually larger one by one, respectively, in the rotating direction of the rotor 25 (FIG. 3). The characteristic curve F is of the fixed displacement compressor having no return ports. Sums of the cross-sectional areas and angular positions of the return ports are equal, respectively. Therefore, the cooling capacities are equal. As shown in the figure, specially in low rotation speed, the input torques of the characteristic curves D, C and A are larger in this order and that of the characteristic curve A is very slightly larger above that of the characteristic curve F. The reason is due to that ratio of compression is high at large rotation angle and amount of reexpansion of high pressure gas is large. Therefore, to get high efficiency, the cross-sectional area of the return ports should be made gradually smaller one by one in rotating direction of the rotor 25 (FIG. 3).

Although the above-mentioned embodiments of the present invention are for the rotary compressor of sliding vane type, the present invention are also applicable to an ellipse-shaped cylinder and a through-slot vane type compressor, and the application can be expanded to a rolling piston type compressor and a scroll type compressor.

While specific embodiments of the invention have been illustrated and described herein, it is realized that other modifications and changes will occur to those skilled in the art. It is therefore to be understood that the appended claims are intended to cover all modifications and changes as fall within the true spirit and scope of the invention.

What is claimed is:

1. A variable capacity compressor comprising:

an enclosure having cylindrical internal space, a cylindrical-shaped rotor which is rotatably held in said enclosure and driven by an external force, the rotor having vanes, plural return ports formed in a wall of said enclosure within a volume-decrease-step space in said internal space wherein a volume of sectioned space formed by movements of said rotor and said vanes is changed cyclically, and, a C-shaped guide passage formed in said wall for communicating said plural return ports with said exit;

an arc-shaped slider which is slidably disposed in said C-shaped guide passage to control communication between said plural return ports and said exit, said slider having an arc-shaped aperture for opening said return ports and an inner passage for communicating said plural return ports with said exit through said aperture;

urging means for urging said arc-shaped slider in a circumferential direction relative to said slider, to close said return ports; and pressure control means for adjusting pressure of gas which pushes said arc-shaped slider in a reverse direction to said urging means.

2. The variable capacity compressor of claim 1 wherein each plural return port is gradually smaller in cross-sectional area in a rotating direction of said rotor.

* * * * *

UNITED STATES PATENT AND TRADEMARK OFFICE

CERTIFICATE OF CORRECTION

PATENT NO. : 4,890,986

DATED : January 2, 1990

INVENTOR(S) : Tatsuhisa Taguchi, Yoshikazu Abe, Kiyoji Aburaya

It is certified that error appears in the above-identified patent and that said Letters Patent is hereby corrected as shown below:

In claim 1, line 9, after "cyclically," insert:

an exit being formed on said wall of volume-increase step-space in said internal space wherein a volume of sectioned space formed by movements of said rotor and said vanes is changed cyclically,

Signed and Sealed this

Sixteenth Day of April, 1991

*Attest:*

HARRY F. MANBECK, JR.

*Attesting Officer*

*Commissioner of Patents and Trademarks*